United States Patent [19]

Hammond et al.

[11] Patent Number: 4,954,935

[45] Date of Patent: Sep. 4, 1990

[54] LIGHTING SYSTEM FOR ILLUMINATING BILLBOARDS AND THE LIKE

[75] Inventors: Douglas S. Hammond; Herbert A. Odle, both of Newark, Ohio

[73] Assignee: Holophane Company, Inc., Newark, Ohio

[21] Appl. No.: 308,166

[22] Filed: Feb. 8, 1989

[51] Int. Cl.[5] ..... F21V 5/00

[52] U.S. Cl. ..... 362/245; 362/234; 362/263; 362/309; 362/812; 40/560

[58] Field of Search ..... 362/234, 238, 245, 263, 362/308, 309, 310, 812; 40/559, 560, 624

[56] References Cited

U.S. PATENT DOCUMENTS

| | | | |
|---|---|---|---|
| 2,746,187 | 5/1956 | Ennever | 40/624 |
| 4,037,341 | 7/1977 | Odle et al. | 362/309 X |
| 4,451,875 | 5/1984 | Odle et al. | 362/812 X |
| 4,575,783 | 3/1986 | Hammond | 362/812 X |

*Primary Examiner*—Stephen F. Husar

*Attorney, Agent, or Firm*—Cornelius P. Quinn

[57] ABSTRACT

A new and improved lighting system for illuminating signs such as billboards and the like which increases the amount of light illuminating the light from a light source by 15 to 20% as compared with previous systems and decreases the variance of illumination intensity by 50%.

8 Claims, 8 Drawing Sheets

LIGHTING SYSTEM FOR ILLUMINATING BILLBOARDS AND THE LIKE

BACKGROUND OF THE INVENTION

This invention relates to a lighting system and more particularly to a new and novel outdoor lighting system for use in illuminating a large panel of an outdoor advertising billboard sign comprising a number of panels. The system includes a number of luminaires one for each panel of the sign. The panel to be illuminated by each luminaire is generally 12' wide and 20' high.

In systems for illuminating signs it is desirable to direct as much light from the light source to the sign from an energy conservation consideration and also to light the sign uniformly so as to provide an attractively lit and legible sign.

In optical systems for illuminating signs prior to the present invention various factors tended to lessen the maximum utilization of light from a light source. These factors included not only limitations on the positioning of the light source itself but the limitations on getting direct light and reflected light to desired areas of the sign.

SUMMARY OF THE INVENTION

In order to overcome problems inherent in the use of prior art systems there has been provided by the subject invention a new and novel lighting system designed for mounting a luminaire in front of each panel of an outdoor advertising sign comprising one or more panels. In the new and novel lighting system a luminaire is mounted in the central portion of each panel of the advertising sign below the sign as hereinafter described.

Each luminaire utilizes a super metal halide lamp, designed to burn at a tilt of 20° above the horizontal, positioned within a lamp housing which is mounted on the outside of the advertising sign panel. The lamp is mounted in a housing and is provided with known means for igniting it. The housing also contains a reflector which is positioned behind the lamp and is designed to reflect light radiating from the lamp. The reflector is designed so that the basic contour of the reflector perpendicular to the longitudinal axis of the lamp is a parabola. The reflector is also provided with a number of flutes or reflecting segments for reflecting light from the lamp and spreading the light laterally across the panel. A refractor positioned over the lamp in the lamp housing is designed to pass all of the reflected light from the reflector through the center area of the refractor where no refraction takes place.

Accordingly, it is an object of the present invention to provide a lighting system which maximizes the utilization of light from light sources to provide a uniformly lit sign.

Another object of the present invention is to provide a lighting system which, while providing for a uniformly lit sign increases the amount of light illuminating the sign from a light source by 15% to 20% as compared with previous systems.

Still another object of the present invention is to provide a lighting system which, while increasing the amount of light illuminating a sign from a light source by 15% to 20% as compared with previous systems, also decreases the variance of illumination intensity by 50%.

These and other objects and advantages of the invention will become apparent from a review of the specification and from a study of the drawings which show a preferred embodiment of the invention by way of illustration only.

DESCRIPTION OF THE PREFERRED EMBODIMENT

Figure 1:
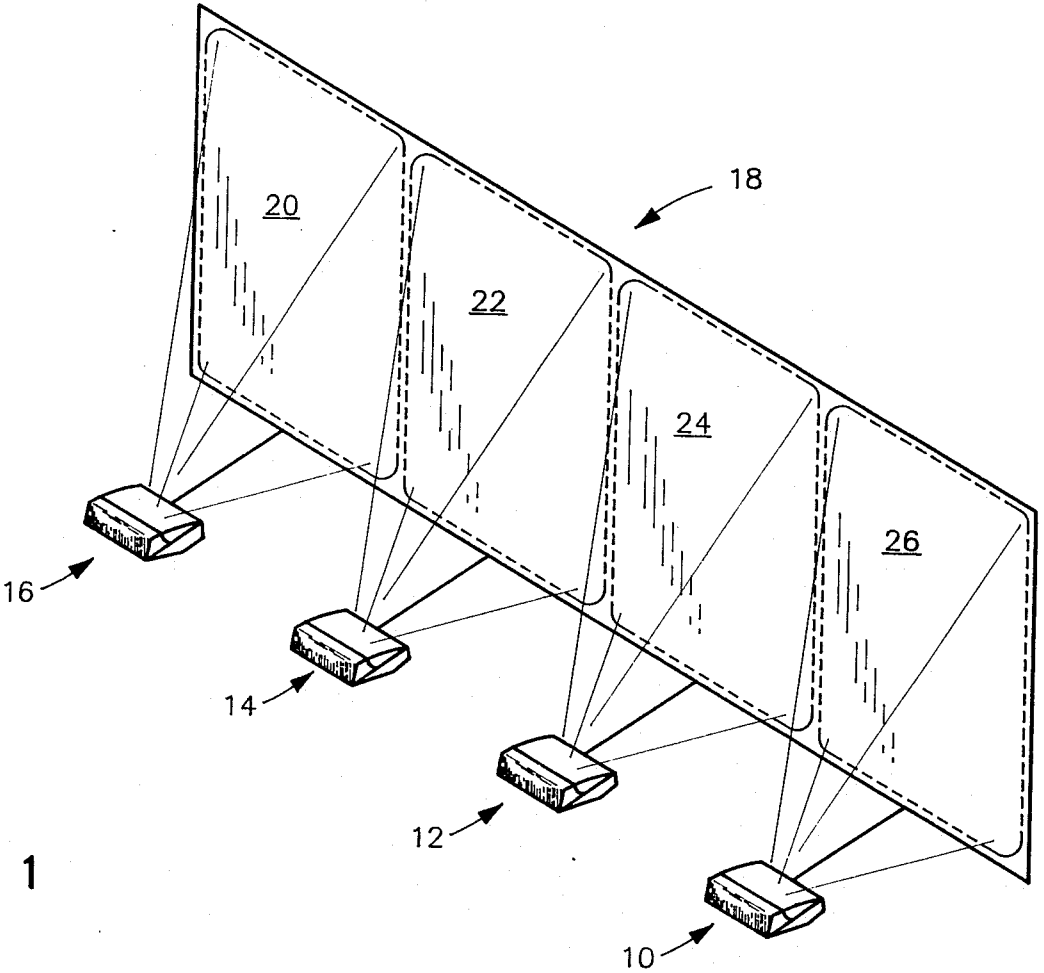
FIG. 1 is a perspective view of Applicant's lighting system employing a number of luminaires mounted somewhat lower and out from the bottom edge of their inspective panels.

Referring now to the drawings, there is shown in FIG. 1 a number of luminaires generally identified by the reference numerals 10, 12, 14, and 16 for illuminating a sign generally identified by the reference numberal 18 which is made up of a number of panels 20, 22, 24, and 26. In the lighting system of the present invention each of the luminaires 10, 12, 14, and 16 are alike and are adapted to provide identical light illumination patterns on their respective panels of the sign 18. The luminaires 10, 12, 14, and 16 are each positioned approximately in the center, three feet down and six feet out from the bottom edge of their respective sign panel.

While super metal halide lamps generating 40,000 lumens of light have been used previously for illuminating signs, in the past in order for them to function properly the position of the lamp was critical and the lamp could only be lit while in a horizontal position. Now, as a result of advanced lamp technology, it is possible to design a super metal halide lamp to burn at any desired tilt as long as the specific tilt is designed into the lamp by the lamp manufacturer.

Figure 2:
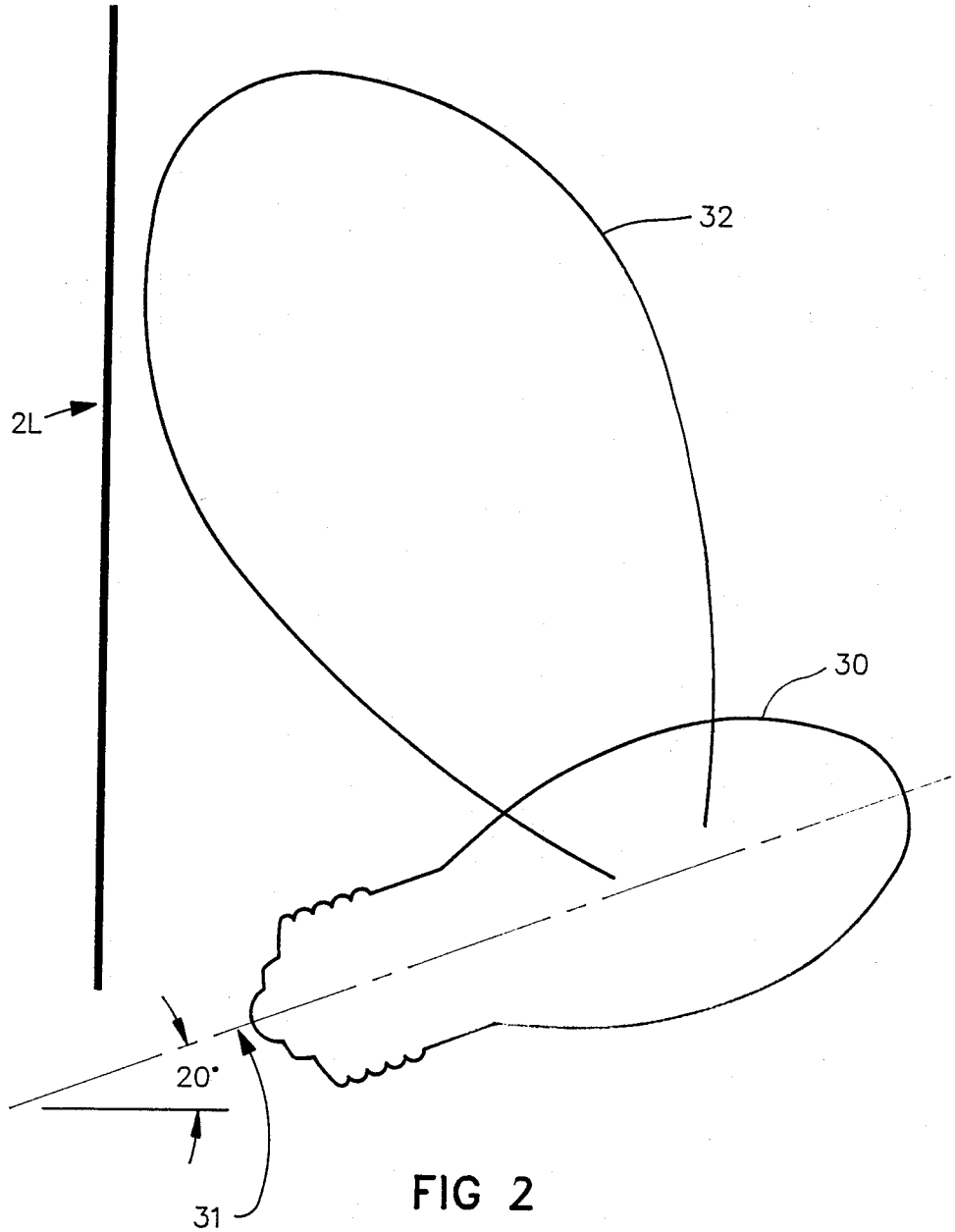
FIG. 2 is a side view showing the positioning of the lamp of a luminaire relative to the sign.

Accordingly, in the present invention as illustrated in FIG. 2 a super metal halide lamp 30 is positioned so that a vertical plane through the lamp's longitudinal axis 31 is perpendicular to a panel of the sign such as panel 26 and the longitudinal axis 31 of the lamp is tilted 20° from the horizontal. The lamp 30 emits a donut of light (half of which is identified by reference numeral 32) and by so positioning the lamp 30, the donut of light 32 is directed toward the sign panel 26 resulting in a maximum amount of direct light illuminating the sign panel 26. While the socket end of the lamp 30 in FIG. 2 is shown positioned toward the sign panel 26 it is to be understood that in accordance with the present invention the socket of the lamp 30 can be directed either toward or away from the sign panel 26.

Figure 3:
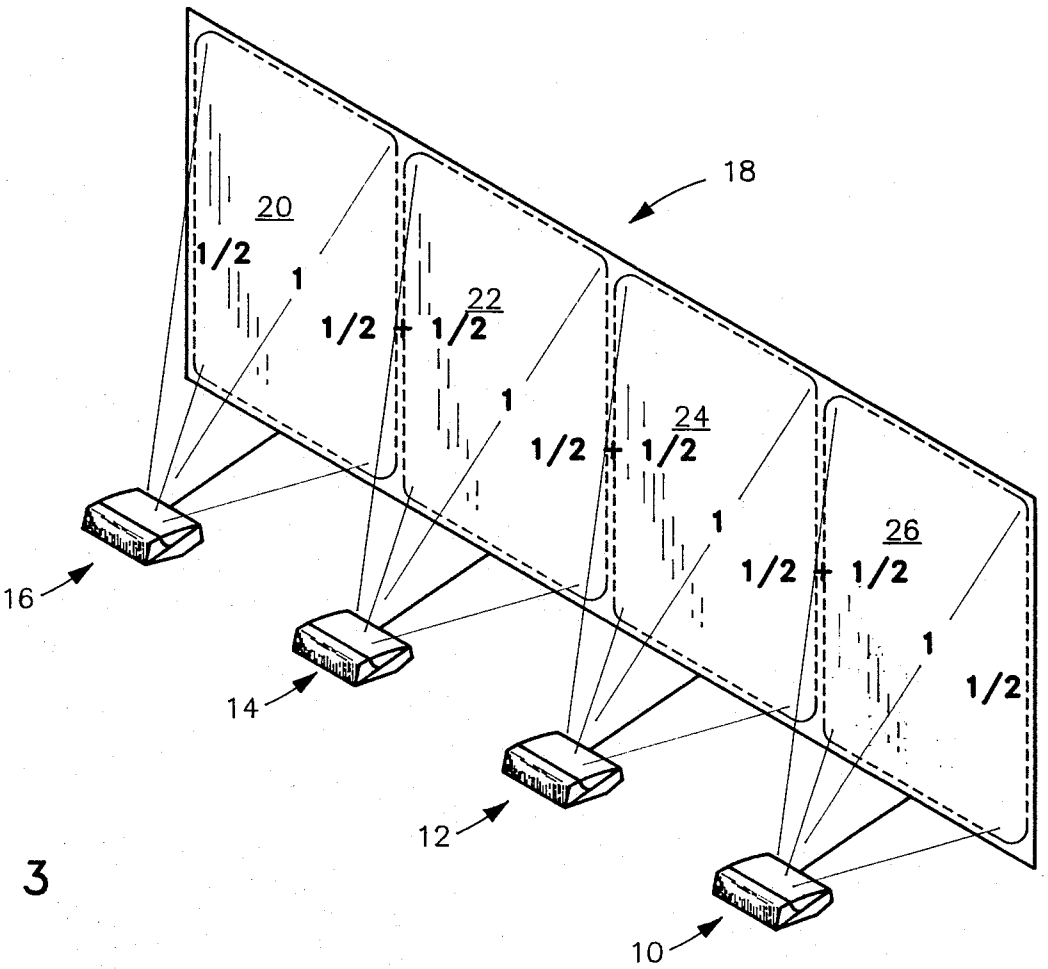
FIG. 3 is a perspective view of Applicant's lighting system illustrating the function of the luminaires is illuminating the sign.

An important function of the present invention as illustrated in FIG. 3 is to redirect as much light as possible from each luminaire 10, 12, 14, and 16 to the center of its respective sign panel, then spreading the light across each of the sign panels to distribute the light from each of the luminaires so that the light from each luminaire deposited on the sides of the panels of the sign panels 20, 22, 24, and 26 is only ½ as intensive as the light in the center of the panel and the overlapping light from adjacent sign panels cumulatively provides the sides of each sign panel, with the exception of the far side ends of the sign 18, with the same amount of light as the center of each sign panel.

The redirecting of light to the center of the sign panels is achieved by providing each luminaire with a reflector 40 so designed that its basic contour is perpendicular to a plane passing through the longitudinal axis of the lamp is a parabola. This is true for any cross-sectional plane perpendicular to the lamp axis along the contour parallel to the lamp axis.

The spreading of light across the sign panels is achieved by providing the reflector 40 with flutes or reflector segments 42 as illustrated in FIGS. *7a*, *7b*, and *7c*. A plane along the centerline path of each segment 42 is perpendicular to its respective sign panel and the physical shape of the segment 42 in cross-section is a mirror image with respect to the centerline axis of the segment. As illustrated in cross-section in FIGS. *7a* and *7c* the segments 42 have a curved lateral surface. While in theory this surface can be either concave or convex due to hydroforming restrictions the most well defined segment is the convex surface.

Figure 4:
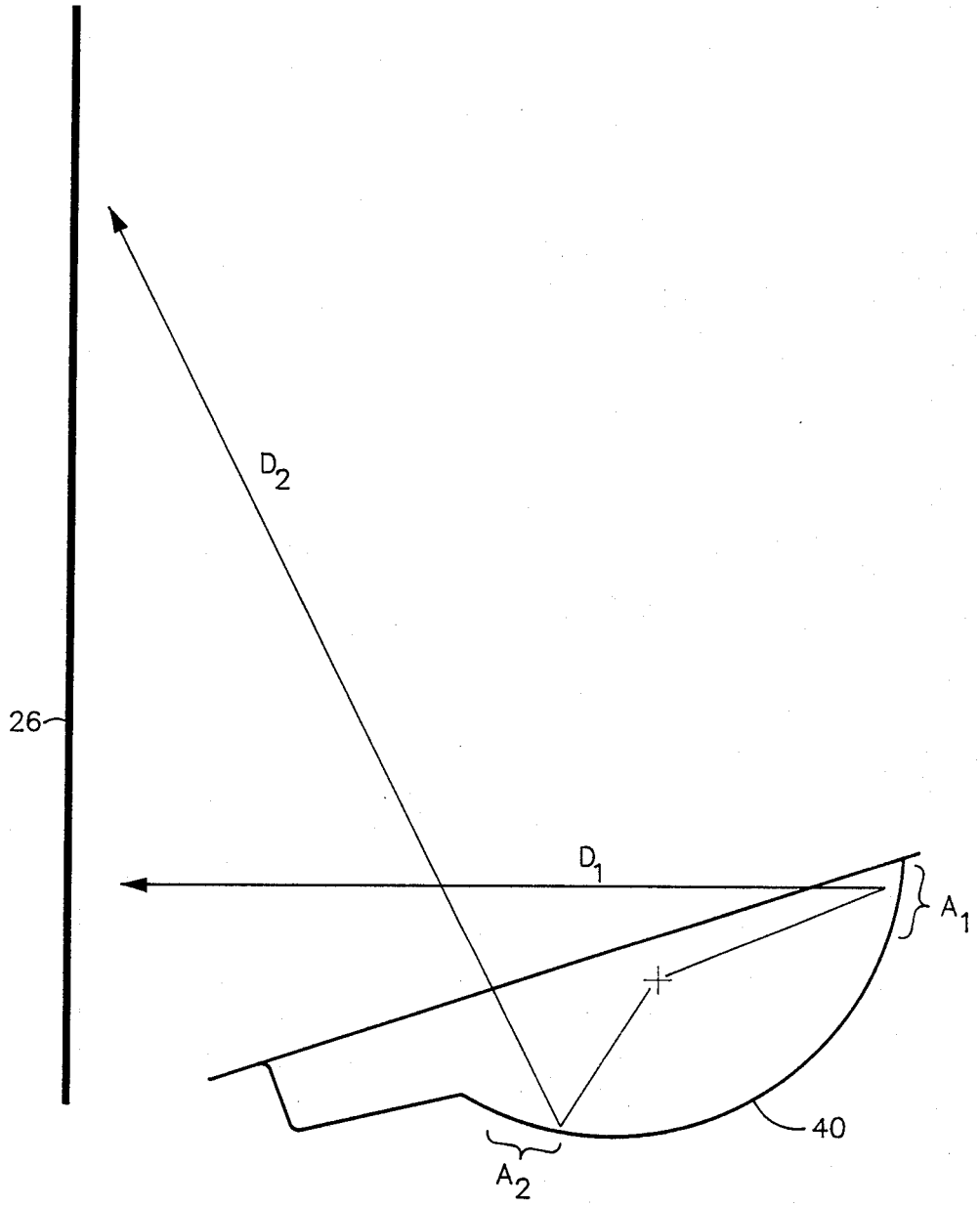
FIG. 4 is a side cross-sectional view of the reflector of the present invention illustrating the directing reflected light to the bottom and the top of a sign panel to be illuminated.
Figure 5:
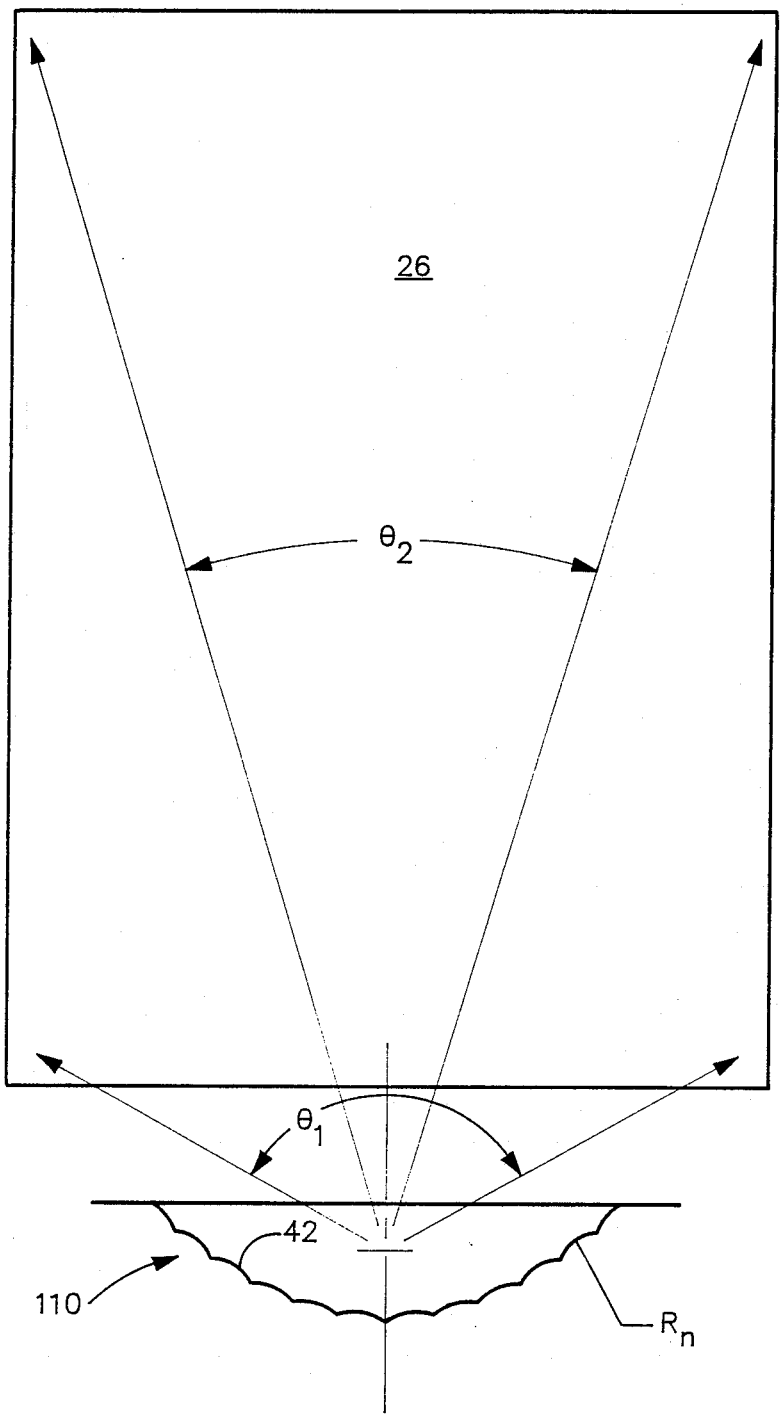
FIG. 5 is an illustration of the angular spread of the light directed to the bottom of the sign panel and the top of the sign panel by the reflector.

As illustrated in FIG. 4 the area $A_1$ of the reflector 40 the area positioned the furthest away from the sign panel 26, redirects light to the bottom of the sign panel 26 and the area $A_2$ of the reflector 40, the area positioned closest to the sign panel 26 redirects light to the top of the sign panel 26. Therefore, the distance $D_1$, over which the area $A_1$ of the reflector 40 has to direct light is much shorter than the distance $D_2$, over which the area $A_2$ has to direct light. Consequently as shown in FIG. 5 the angular spread $\theta_1$ and $\theta_2$ through which the area $A_1$ and $A_2$ of the reflector has to redirect light differ greatly. Since the radius of curvature of the reflecting segments 42 determine the lateral spread of the desired light pattern the radius of curvature of the reflecting segment 42 at $A_1$ is smaller than the radius of curvature of the reflecting segment 42 at $A_2$. In order to uniformly spread the redirected light laterally from the bottom of the sign panel 26 to the top of the sign panel 26, the radius of curvature of each of the reflecting segments 42 is made to gradually increase from the beginning at area $A_1$ of the reflecting segments 42 until it reaches area $A_2$ of the reflecting segments.

Another feature of the present invention is the interaction of a refractor 50 with the reflector 40. The primary function of a refractor normally is to enhance illumination cosmetically and redirect direct light which would otherwise be lost or of no-use to become useful. However, in prior art systems often times reflected light is passed through a point on the refractor through which direct light from a lamp also passes and the action of the refractor in making the direct light useful results in the reflected lighting becoming non-useful.

Figure 6:
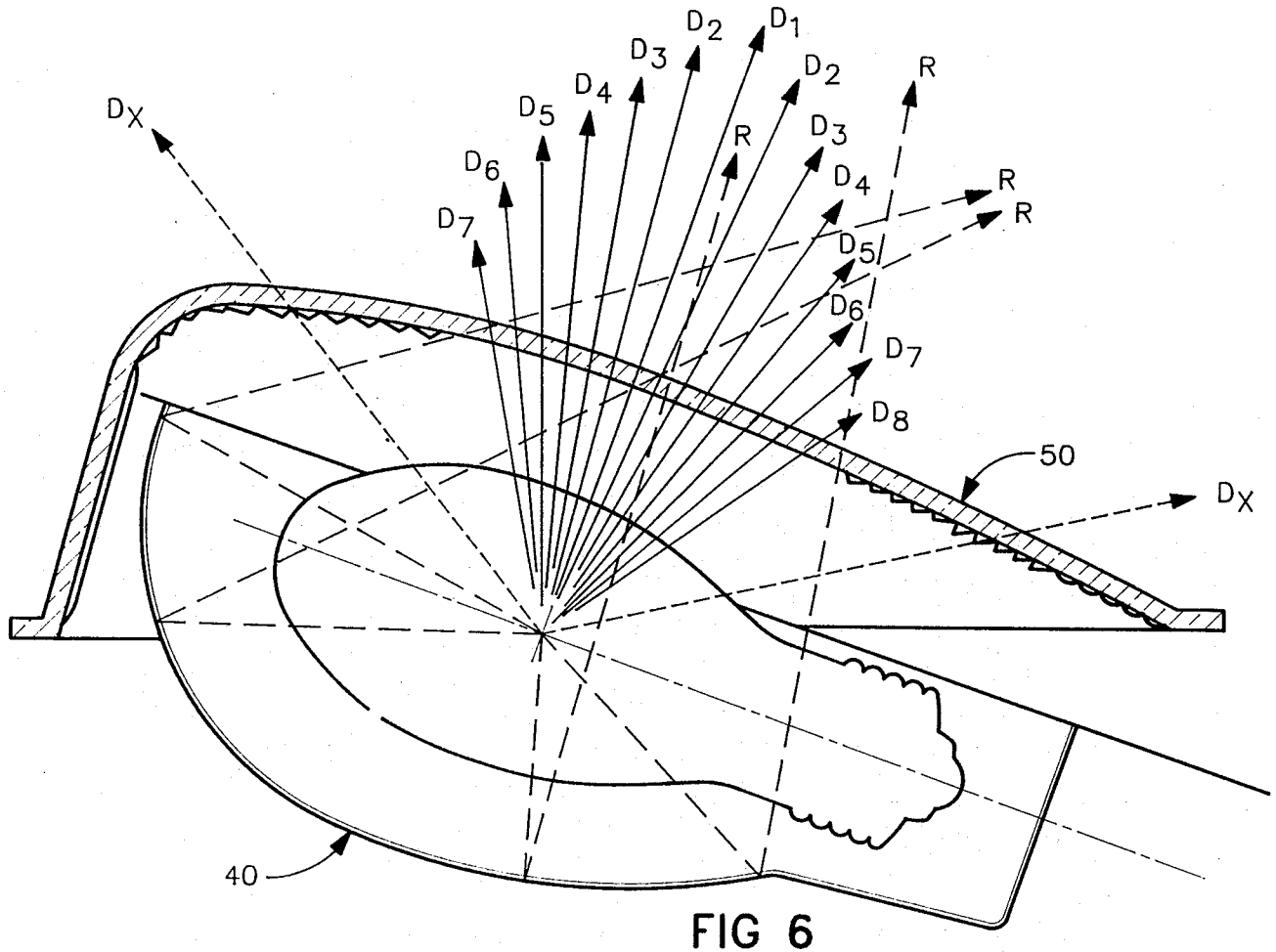
FIG. 6 is a cross-sectional view of the light fixture of the present invention incorporating a refractor and illustrating the passing of the reflected light through the portion of the refractor which is free of prisms.
Figure 7A:
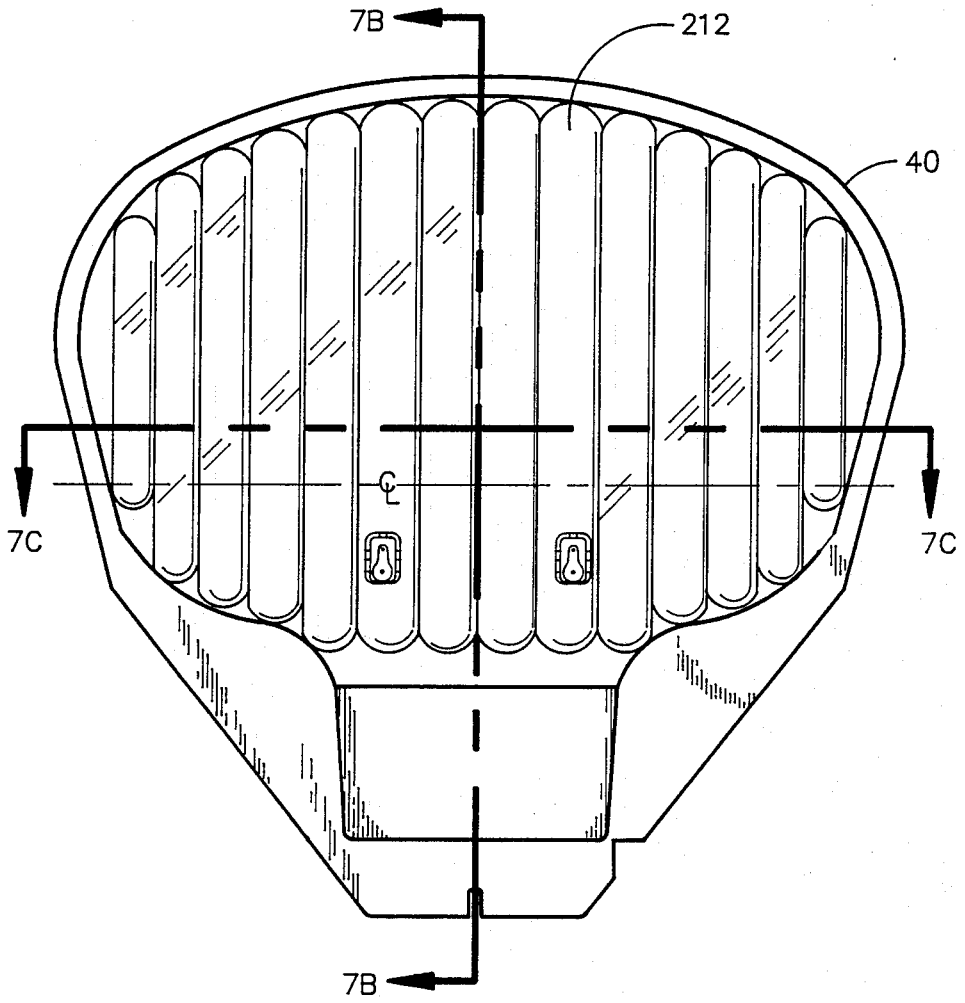
FIG. 7*a* is a front view of the reflector of the present invention.
Figure 7C:
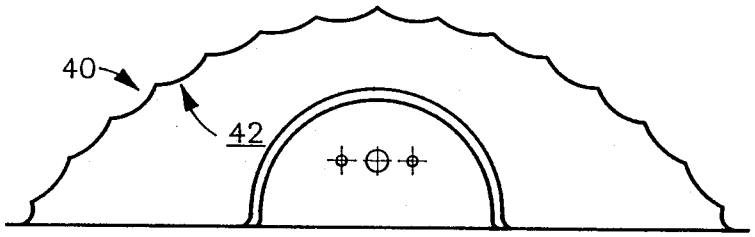
FIG. 7*c* is a cross section view of the reflector of the present invention taken along B—B in FIG. 7*a*.
Figure 7B:
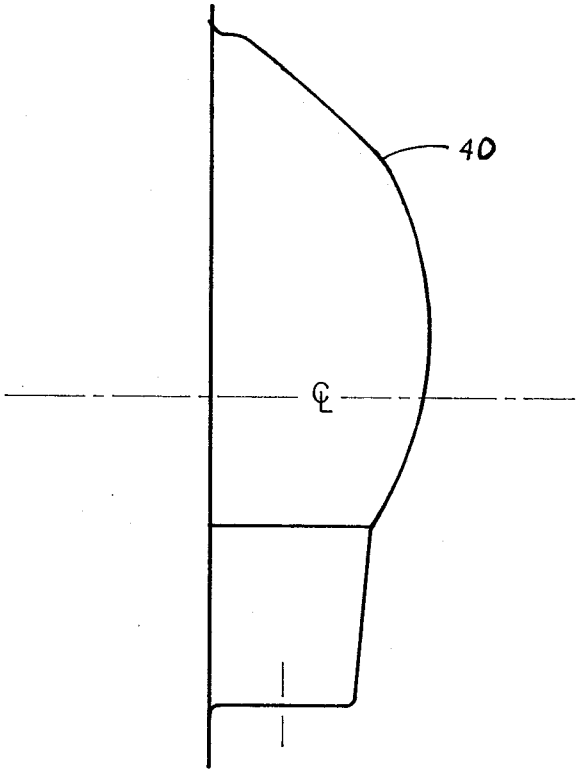
FIG. 7*b* is a side cross section view of the reflector of the present invention taken along A—A in FIG. 7*a*.

As a result such optical systems were inefficient. A feature of the present invention is to eliminate this inefficiency of the prior art and provide a reflector, and a refractor as shown in FIG. 6, so designed that all of the reflected light is directed by the reflector as useful light and travels along unencumberd just as the useful direct light from the lamp. As indicated in FIG. 6 all of the reflected light is directed through the center of the refractor. The only light which is bent passes through the refractor outside of the center area and is direct light which thus can be controlled without any loss or degradation of reflected light.

The present invention thus provides a lighting system which while providing for a uniformly attractive lit sign increases the efficiency of illuminating a sign from a light source by 15% to 20% when compared with prior art systems and at the same time decreases the variance of illumination intensity by 50%.

While the invention is particularly shown and described in reference to a preferred embodiment thereof, it will be understood by those skilled in the art that various changes in form and details may be made therein without departing from the spirit and scope of the invention.

What is claimed is:

1. A lighting system for illuminating a sign having one or more panels, each of said panels having its vertical height greater than its horizontal width, said lighting system comprising, a luminaire for each panel, each of said luminaires including a lamp positioned below and away from the central portion of its respective panel in such a manner as to provide a maximum amount of luminance directly from the lamp to said panel, reflector means for reflecting luminance directly to the panel, and refractor means for redirecting direct light to illuminate the panel whereby the central portion of each panel receives twice the illumination than the sides of the panel so that overlapping light from adjacent sign panels will cumulatively provide the adjacent sides of sign panels with the same amount of light as the center of each sign panel.

2. A lighting system as defined in claim 1 wherein said lamp is positioned slightly below and out from the center of the bottom edge of one of the sign panels so that a verticla plane through the lamps longitudinal axis is perpendicular to said sign panel and the longitudinal axis is tilted 20° from horizontal.

3. A lighting system as defined in claim 2 wherein said lamp is a super metal halide lamp.

4. A lighting system as defined in claim 3 wherein said reflector means includes a reflector the basic contour of which is parabolic.

5. A lighting system as defined in claim 4 wherein each of said reflectors has a plurality of reflector segments in the form of flutes for spreading light across the sign panel.

6. A lighting system as defined in claim 5 wherein a plane along the centerline path of each reflector segment is perpendicular to the sign and the physical shape of each of the reflector segments in a cross-section is a mirror image with respect to the center line axis of the segment.

7. A lighting system as defined in claim 6 wherein the radius of curvature of each of the reflecting segments gradually changes from one end to the other of the reflecting segment.

8. A lighting system as defined in claim 7 wherein said refractor means is provided with prisms positioned to only control and redirect stray direct light and not interfere with any reflected light.

* * * * *